United States Patent [19]

Camacho et al.

[11] 4,067,390

[45] Jan. 10, 1978

[54] APPARATUS AND METHOD FOR THE RECOVERY OF FUEL PRODUCTS FROM SUBTERRANEAN DEPOSITS OF CARBONACEOUS MATTER USING A PLASMA ARC

[75] Inventors: Salvador Lujan Camacho, Raleigh, N.C.; Louis Joseph Circeo, Jr., Mons, Belgium

[73] Assignee: Technology Application Services Corporation, Raleigh, N.C.

[21] Appl. No.: 702,964

[22] Filed: July 6, 1976

[51] Int. Cl.[2] ..... E21B 43/24

[52] U.S. Cl. ..... 166/302; 166/272; 166/303; 166/60; 299/2

[58] Field of Search ..... 166/248, 250, 251, 256, 166/257, 259, 261, 267, 272, 302, 303, 60; 175/16; 299/2, 14; 48/202, 210, DIG. 6; 208/11 R; 219/121 P

[56] References Cited

U.S. PATENT DOCUMENTS

| | | | |
|---|---|---|---|
| 3,122,212 | 2/1964 | Karlovitz | 175/16 X |
| 3,384,467 | 5/1968 | Ammann et al. | 48/210 X |
| 3,443,639 | 5/1969 | Patterson et al. | 175/16 X |
| 3,454,365 | 7/1969 | Lumpkin et al. | 166/251 UX |
| 3,522,846 | 8/1970 | New | 166/303 |
| 3,605,890 | 9/1971 | Holm | 166/261 |
| 3,734,184 | 5/1973 | Scott | 166/259 |
| 3,818,174 | 6/1974 | Camacho | 219/121 P |
| 3,892,270 | 7/1975 | Lindquist | 166/251 |
| 3,905,553 | 9/1975 | Bladley et al. | 166/261 X |
| 3,954,140 | 5/1976 | Hendrick | 166/60 X |

OTHER PUBLICATIONS

"Induction Plasma Flame—A New Heat Source for Industry," TAFA Division, Humphreys Corporation, Bulletin 4R, March, 1965.

*Primary Examiner*—Stephen J. Novosad
*Assistant Examiner*—George A. Suchfield
*Attorney, Agent, or Firm*—B. B Olive

[57] ABSTRACT

An apparatus and method utilizes a plasma arc torch as a heat source for recovering useful fuel products from in situ deposits of coal, tar sands, oil shale, and the like. When applied to a coal deposit, the plasma torch is lowered in a shaft into the deposit and serves as a means for supplying heat to the coal and thereby stripping off the volatiles. The fixed carbon is gasified by reaction with steam that is sprayed into the devolatilized area and product gases are recovered through the shaft.

When applied to tar sands and oil shale, the torch is lowered in a shaft into the deposit and serves as a heat source to allow the entrapped oil in the tar sand or the kerogen in the oil shale to flow to a reservoir for collection. When economically justified, the carbonaceous matter in the tar sands or oil shale deposits may be partially or completely pyrolyzed and recovered as gaseous fuel products.

Monitoring means for continuously analyzing selected properties of the fuel products enable the operator to control the operating parameters within the shaft. Subsidence of the coal deposit overburdens can be avoided by leaving pillars for support.

27 Claims, 10 Drawing Figures

APPARATUS AND METHOD FOR THE RECOVERY OF FUEL PRODUCTS FROM SUBTERRANEAN DEPOSITS OF CARBONACEOUS MATTER USING A PLASMA ARC

CROSS-REFERENCE TO RELATED APPLICATION

This application is related to copending application Ser. No. 645,413, entitled "Apparatus and Method for the Gasification of Carbonaceous Matter by Plasma Arc Pyrolysis", filed Dec. 30, 1975, and which teaches a process for gasification of carbonaceous matter by pyrolysis in a furnace structure.

BACKGROUND OF THE INVENTION

1. Field of the Invention:

The invention relates to apparatus and methods for the recovery of fuel products from in situ deposits carbonaceous matter. In particular, the invention relates to the gasification of coal deposits and the recovery and liquid fuels from deposits of tar sands and oil shale by introducing a plasma arc torch into the deposits to heat and sustain reactions within the deposits.

2. Description of the Prior Art:

It is well known that the finding rate of natural gas and oil in the western world has greatly decreased in recent years while the demand has steadily risen. As a result, the United States has become increasingly dependent on foreign sources to meet its gas and oil demands. Recently, it has been estimated by the Institute of Gas Technology that the demand for natural gas in the United States will exceed production in the United States (including imports from Mexico and Canada) by 7.8 trillion cubic feet in 1980 and 18.3 trillion cubic feet in 1990 unless some new means can be found to supplement the supply.

In order to assure the energy independence of the United States, there is an acute need to develop new sources of clean fuel to meet the energy demands. In the United States, coal, tar sands, and oil shale are the only remaining fossil fuel sources which are abundantly available. It has become increasingly apparent that the use of the vast reserves of such carbonaceous fuels is the most practical means of meeting the energy requirements for the near future. Numerous attempts have been made to develop a workable process for coal gasification, both in situ and in surface gasifiers using mined coal. However, work in the development of new coal gasification processes has remained relatively dormant until the past few years and no known process has emerged which is economically feasible and has a minimum effect on the environment. Likewise, attempts to recover fuel products from in situ deposits of tar sands and oil shale have, to date, proved commercially unacceptable.

In Situ Coal Gasification

Underground gasification is the most promising of the various proposed alternatives to the conventional mining of coal and potentially has several inherent advantages over conventional mining. Examples of such advantages include the avoidance of safety and health hazards related to the underground mining of coal, avoidance of the environmental impact which occurs during strip mining of coal, avoidance of the problems of spoil banks, slag piles and acid mine drainage, and an ability to recover coal from seams unsuitable for conventional mining techniques.

The underground gasification of coal was first proposed in the mid-19th century. Small-scale experiments were conducted prior to the First World War; however, the first substantial work in testing was done in Russia starting in the 1930's. The gas produced by the Russian project was used for the generation of electricity and to supply local industries. Little progress has been made in processes for the in situ gasification of coal in the past decade due primarily to the lack of economic incentives and also due to the serious technical problems such as the lack of process control and the resultant inability to produce gases of a predictable quality and quantity.

All known prior art processes for the in situ gasification of coal require the combustion of a portion of the coal to provide the heat for gasification, and in almost all cases the combusion gases and product gases are mixed resulting in a dilute product gas. The prior art processes may be divided into three basically distinct operations: pre-gasification, gasification, and utilization.

The pre-gasification step generally involves the providing of access to the coal seam by boring of an injection (inlet) hole and a production (outlet) hole. The bore holes must then be linked or connected by means of explosive fracturing, electrolinking, pneumatic linking, hydraulic linking, or the like and next for the gasification step involves:

1. The introduction of gasification agents through the injection bore hole. Such gasification agents include air, air enriched with oxygen, alternating air/steam, oxygen/steam, and oxygen/$CO_2$.

2. Ignition of the coal seam by electrical means or by burning of solid fuels.

3. Contacting between the gasification agents and the coal seam at a "flame front". The flame front may advance in different directions through the seam.

4. Process controls which include the control of groundwater, the prevention of roof collapse, temperature control at the flame front, leakage control, and monitoring the progress of gasification.

The utilization step involves utilizing the product gas as an energy source or for a non-energy use. As an energy source, the gas may be used for nearby electricity generation and transmission or for neaby production of pipeline quality gas. Non-energy uses include using the product gas as a reductant, as a hydrogen source, or as a raw material for a chemical plant.

There are several reasons why the available methods cannot produce a realiaby high quality and constant quantity of gases, recover a high percentage of coal in the ground, control ground subsidence, or groundwater contamination. The primary technical problem areas are the following:

1. The combustion cannot be effectively controlled. The contacting between the coal and the reacting gas should be such that the coal in situ is gasified completely, the production of fully burned $CO_2$ and $H_2O$ is minimized, and all free oxygen in the inlet gas is consumed. However, roof collapse and a loss of contact between the coal and reacting gases has made effective combustion control virtually impossible.

2. After the coal is burned away, a substantial roof area is left unsupported and, therefore, collapses. The roof collapse causes problems in combustion control; and, because of its unpredictability, greatly hinders the successful operation of the gasification process. It also results in a leakage of the reactant gases, the seepage of groundwater into the coal seam, the loss of product gas, and surface subsidence above the coal deposit.

3. Except under special circumstances, a coal bed does not have a sufficiently high permeability to permit the passage of oxidizing gases through it without an excessive high pressure drop. The above-mentioned linking techniques for increasing permeability cause problems with leakage and disruption of surrounding strata.

4. The influx of water through leakage can greatly disrupt the conventional in situ gasification processes. The leakage potential is, of course, unique to each gasification site. 5. The most serious technical problem arises in the monitoring of the underground processes. As a practical matter, no adequate process control philosophy has evolved for controlling underground gasification of coal because of the lack of effective monitoring means and because of the inability to control such factors as the location and shape of the fire front, the temperature distribution along the first front, roof collapse and ground subsidence, the permeability of the coal seam, leakage and bypassing of reactants and products, leakage of groundwater, and the composition of the product gas.

U.S. Pat. No. 3,794,116 discloses a method for in situ gasification of a relatively thick coal deposit whereby the deposit is first fractured by explosives to increase its permeability. Oxygen and fuel gas are injected into the deposit through an injection well to ignite the coal. Water or steam is injected into a second well to act as a reactant. Similar methods are taught in U.S. Pat No's. 3,734,184 and 3,770,398. These methods have failed to overcome the many disadvantages listed above, and particularly the waste of coal and the dilution of the product gas caused by the combustion of a large portion of the coal. A particular injector construction for injecting a mist of a treating fluid or reactant into a well is disclosed in U.S. Pat. No. 3,905,553.

U.S. Pat. No. 3,924,680 discloses a technique for the so-called "pyrolysis" of coal in situ. A lower stratum of coal is burned to produce the heat necessary to pyrolyze the stratum directly above it. No steam is introduced and, therefore, primarily only the volatiles are stripped off while the fixed carbon remains ungasified. This patent teaches the method of driving the fluid tars out of the coal and drivng them outwardly from the heated portion of the deposit so they will solidify in a lower temperature zone to define a fluid imprevious barrier around the gasification site.

U.S. Pat. No. 3,892,270 discloses the step of controlling the combustion rate in the underground formation in response to the monitoring of the Btu value of the product gas being withdrawn from the production well.

A study of the prior art indicates that there is an acute need for a truly feasible and efficient system for the in situ gasification of coal. No radical departure has been made from the above-described prior art techniques which will overcome the inherent problems set forth above. It is an object of the present invention to provide an apparatus and method for the in situ gasification of coal having the following characteristics:

A. The endothermic heat requirement is supplied without combustion of any part of the coal seam being gasified; thus, true pyrolysis may be achieved and part of the coal is not wasted in conversion to $CO_2$ and $H_2O$. The elimination of the dilution caused by gaseous combustion products results in a higher quality product fuel gas.

B. No linking by explosive fracturing or other means is required.

C. No appreciable environmental degradation results; subsidence can be controlled or eliminated.

D. The process is capable of being monitored and having a simplified process control responsive to such monitoring for controlling the critical parameters.

E. The process is adaptable, either directly or with minor variations, to the recovery of fuel products from deposits of tar sands and oil shale.

F. Broad temperature and pressure ranges may be achieved for controlling the gasification reactions and the ultimate product gas.

G. The gasification apparatus within the shaft is mobile.

Recovery of Fuel From In Situ Deposits Of Tar Sands And Oil Shale

It is well known that the oil entrapped within a typical tar sands deposit is very viscous which prevents its recovery by conventional drilling techniques. On the other hand, oil shales are solids; the hydrocarbon they contain, kerogen, becomes liquid at elevated temperatures. Heretofore, two thermal methods have been proposed for recovering the oil from such formations. In a first methods, a hot fluid is injected into the subterranean formation to effect a reduction in viscosity of the in situ oil so that it may flow to a recovery point. In a second method, a portion of the oil is burned in the formation to heat the entire formation and liquify or reduce the viscosity of the remaining unburned oil. The first method is extremely expensive and commercially unacceptable for large deposits. The second method has the inherent disadvantage of wasting a large portion of the oil in the combustion process.

U.S. Pat. No. 2,914,309 discloses a method of recovering oil and gas from tar sands by lowering a gas-fired burner into a single well which communicates with the tar sand deposit. The heater serves to pyrolyze the tar sands so that the pyrolysis vapors may be recoverd through the well. These vapors may then be condensed into oil. The patented process does not contemplate the recovery of liquid oil from the base of the well. The patent states that complete pyrolysis requires a temperature of about 380°–400° C and the heating period will last from one to forty weeks with an electrical heating load of from 0.5 to 2.5 kilowatt/meter.

SUMMARY OF THE INVENTION

The apparatus and method of the present invention provides a system for the recovery of fuel products from subterranean deposits of carbonaceous matter. A plurality of well shafts spaced in a predetermined array are drilled through the overburden and into the deposit. Each shaft receives a plasma arc torch which is lowered into the deposit on a flexible support cable having a built-in electrical line, cooling water lines and a plasma gas supply line. The plasma arc torch operates in a transferred mode wherein the arc is attached to an external forwardly placed, axially aligned torch-mounted electrode.

As applied in particular to in situ coal gasification, but also suitable for other carbonaceous deposits, the invention provides a steam line for spraying steam into the shaft to serve as a reactant for gasifying the fixed carbon component of the coal. The heat from the torch first causes a portion of the volatiles to be stripped off and then, with the introduction of steam, the remaining fixed carbon is gasified leaving behind a slag of molten ash. Upon complete gasification, the diameter of the shaft will have increased from approximately 0.5 meter to at least approximately 4 meters. The product gases are withdrawn at the top of the shaft and the slag flows to the bottom of the shaft. Pillars of devolatilized coal may be left behind between the shafts to prevent surface subsidence. The product gases may be upgraded to pipeline quality or used in any other way.

As applied in particular to the recovery of fuel products from oil shale and tar sand deposits, a torch is lowered into a shaft which communicates with the deposit. The heat from the torch serves to liquify or reduce the viscosity of the entrapped oil so that it flows to a collection reservoir at the bottom of the shaft. A portion of the oil may be pyrolyzed by the intense heat and the pyrolysis vapors so formed are collected at the top of the shaft as useful gas.

In both applications the torches are preferrably operated in groups of three in order to best utilize a conventional threephase AC power supply. A monitoring station may be provided for continuously monitoring the temperature, Btu value and mass flow rate of the fuel products. The operating parameters and/or the positioning of the torches may be controlled in response to the monitoring.

DETAILED DESCRIPTION OF THE PREFERRED EMBODIMENT

In broad application, the invention is adapted for the recovery of useful fuel products from virtually any kind of subterranean deposit of carbonaceous matter, including coal, tar sands and oil shale. The preferred embodiment describes an apparatus and method for releasing the volatiles and gasifying the fixed carbon components of in situ coal which normally represents relatively homogenous, high energy carbonaceous matter. With minor variations, and without departing from the scope of the invention, the preferred embodiment may be modified for potentially more economical fuel product recovery techniques of other subterranean deposits of carbonaceous matter including tar sands and oil shale.

Plasma Pyrolysis Technique As Applied To In Situ Coal Gasification

Figure 1:
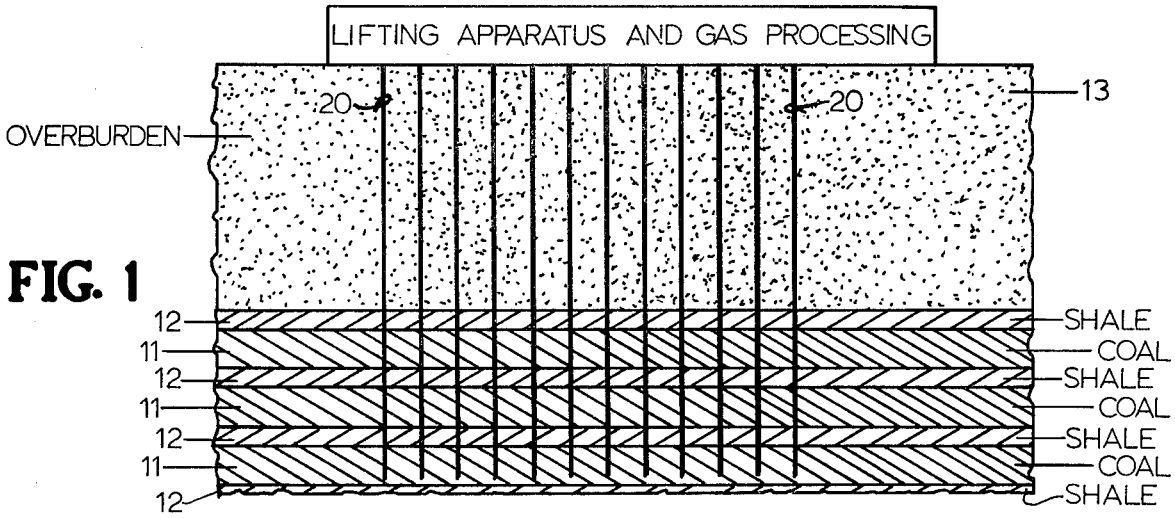
FIG. 1 is a vertical diagrammatic section view of a subterranean formation having typical coal seams and shale layers and showing a plurality of shafts drilled therein for practicing the invention.
Figure 2:
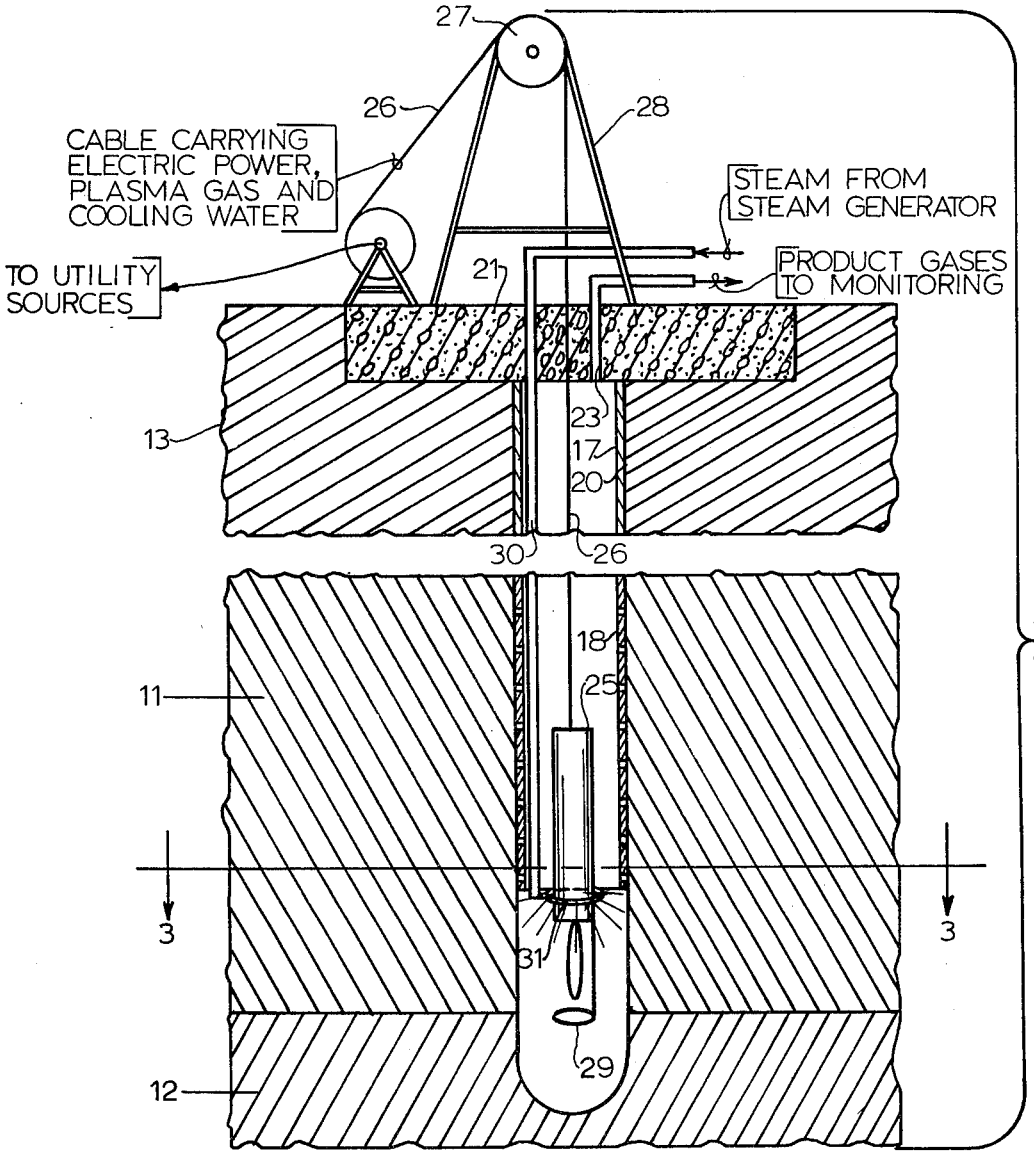
FIG. 2 is an enlarged diagrammatic vertical section view, not to scale, of a single shaft showing a plasma arc torch suspended near the bottom of the shaft.

Referring to the drawings and particularly to FIGS. 1 and 2, a vertical section of a typical coal deposit is shown wherein coal seams 11 are separated by relatively narrow shale layers 12. Above the coal seams 11 and shale layers 12 is an overburden 13 comprising interspersed layers of sandstone and shale.

The coal deposit is prepared for gasification by the drilling of a plurality of vertical well shafts 20 from the surface downward to the lowest coal seam 11 which is to be gasified. Each shaft is fully lined from the ground surface to the bottom of the overburden 13 by an impermeable lining 17. A permeable lining 18, through which gases can freely pass, is placed from the top of the coal seams to the initial torch location; this permeable lining 18 is constructed of materials such that it will be consumed when directly exposed to the plasma torch energy. Below the torch location the shaft is unlined. The described lining technique is utilized to protect the torch and related apparatus. In an unlined shaft it is likely that the hot product gases escaping through the shaft will heat the walls, evaporate the residual moisture, cause thermal gradients to occur and otherwise change the properties of the subterranean materials adjacent the shaft. The net result can be spoliation and collapse of sections of the shaft onto the torch. Although the invention may be practiced utilizing unlined shafts, it is preferble to provide some type of lining for the shaft in most coal deposits. In a preferred embodiment, each shaft 20 is approximately 0.5 meter in internal diameter after being lined and receives a plasma arc torch 25 that serves as a heat source for converting the carbonaceous material to a fuel product.

Preferably, torch 25 is a stabilized long arc column forming liquid cooled plasma arc torch of the type described in U.S. Pat. No. 3,818,174 and manufactured by Technology Application Services Corporation of Raleigh, N.C. A "stabilized arc" as used in the specification refers to an arc having the characteristic of being in stable equilibrium so that the current flow in the arc may be made laminar (i.e., a collimated current flow). According to present technology, the arc may be best stabilized by a gas vortex as taught by U.S. Pat. No. 3,818,174. The stabilized and collimated characteristics of the arc enable the torch to sustain arc lengths greatly in excess of conventional electric arcs. Arcs up to one meter in length may be sustained, for example. An available torch suitable for use with the present invention has an external diameter of approximately 300 millimeters and is approximately four meters long. A forwardly disposed, axially aligned electrode 29 enables the torch to operate in a transferred mode although it is recognized that the arc could attach to other forms of external electrodes or to the deposit itself without departing from the scope of the invention. Electrode 29 may be fixed or made remotely adjustable as required for starting and appropriate arc length. Electrode 29 is liquid cooled by the same water or other liquid supply that cools the torch.

Figure 7:
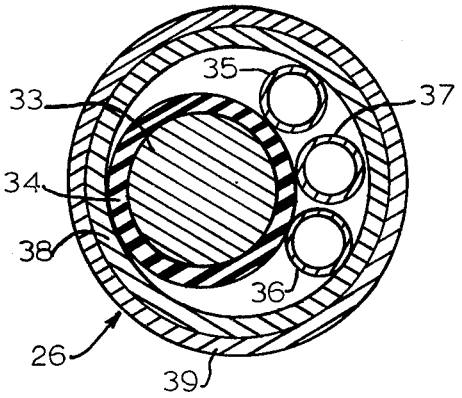
FIG. 7 is a cross section view of the torch support cable showing the current conductor, water line and plasma gas line.

As best shown in FIG. 2, torch 25 is suspended in shaft 20 by a flexible cable 26. Cable 26 is supported from a tower 28 by a lifting apparatus 27. Cable 26 has built-in lines for supplying electrical power and plasma gas and cooling water to the underground apparatus and for withdrawing the heated water. As depicted in the section view of cable 26 in FIG. 7, the electrical current is carried by a central copper braid conductor 33 which is insulated by asbestos insulation 34. The cooling and returned heated water for torch 25 is carried by flexible pipes 35, 36 and the appropriate torch gas supply is fed through flexible pipe 37. When necessary for electrode positioning, torch 25 may be suitably equipped for remote positioning of electrode 29 and in this instance the control wires may be passed through cable 26. The described lines are surrounded by a layer of insulation 38 and an outer cover of steel braid 39 which serves as the load carrying element of the cable. As seen in FIG. 2, the upper end of shaft 20 is capped by a concrete well cap 21 having openings therein for introducing a steam injection line 30, the flexible cable 26, and a product gas removal line 23.

The torch 25 is adapted for vertical movement within shaft 20 so that it may be raised and lowered to the desired depth for heating of the deposit. A preferred manner of operation includes the initial lowering of torch 25 to a position near the bottom of shaft 20 as shown in FIG. 2. Utilizing known techniques, the torch 25 is automatically started and a stabilized, long plasma arc is formed and sustained in a transferred mode; i.e., attached to the external electrode 29 which is part of the electrical circuit. Localized temperatures along the centerline of the plasma arc may reach as high as 7000° C. Torch cooling water is introduced and removed through cable 26. As described in detail below, once a volume of coal immediately surrounding the torch has been heated to approximately 1000° C, the steam is introduced into the shaft 20 through line 30. The steam is preferably sprayed onto the walls of shaft 20 at high pressure by means of an annular nozzle 31 located around torch 25 (see FIG. 2). The initial heat supplied to the coal serves to strip the volatiles from the surrounding coal. The steam serves as a reactant to aid in the gasification of the fixed carbon component of the coal and favors the following watershift reactions:

$$C + H_2O + \text{heat} \rightarrow H_2 + CO$$

$$2C + 2H_2O + \text{heat} \rightarrow CH_4 + CO_2$$

The heat from torch 25 first causes the volatiles to be stripped from the surrounding coal. This devolatilization results in a cracking or fracturing of the coal, thereby increasing its porosity. The devolatilization and fracturing expands radially outwardly as a heat front advances from shaft 20. The increased porosity of the devolatilized coal allows steam to flow outwardly into the seam for reacting with the fixed carbon and also allows the product gases produced by devolatilization and reactions to move inwardly to the shaft 20 for removal. The reaction of steam with the fixed carbon erodes the face of shaft 20 and a slag of molten ash flows downwardly to the bottom of shaft 20.

Figure 3:
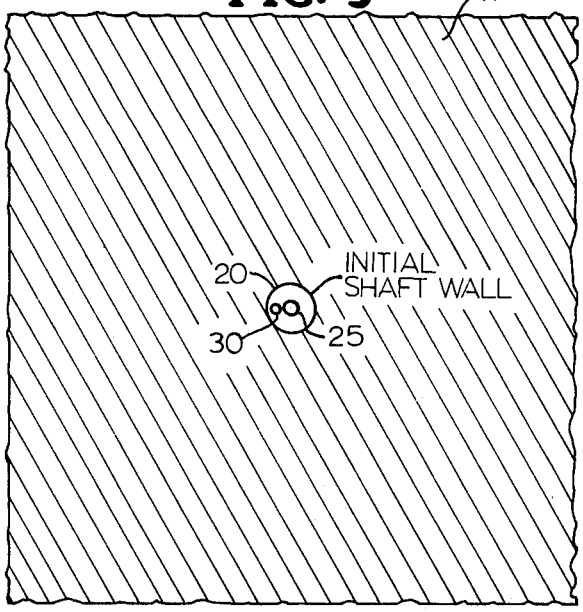
FIG. 3 is a diagrammatic horizontal section view taken substantially along line 3—3 of FIG. 2 and showing the coal deposit around the shaft before the torch is energized.
Figure 4:
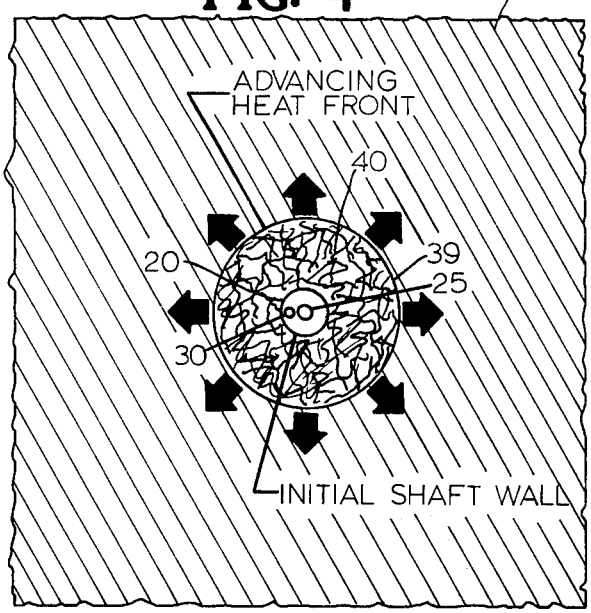
FIG. 4 is a view similar to FIG. 3 and showing the coal seam after the heat front has moved outwardly to devolatilize and fracture a portion of the coal seam.
Figure 5:
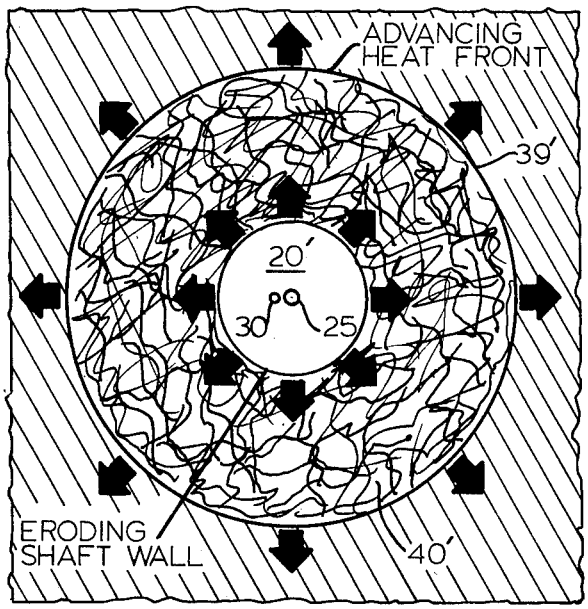
FIG. 5 is a view similar to FIGS. 3 and 4 and showing the coal seam after the heat front has advanced further and after steam has been injected to gasify a portion of the fixed carbon.
Figure 6:
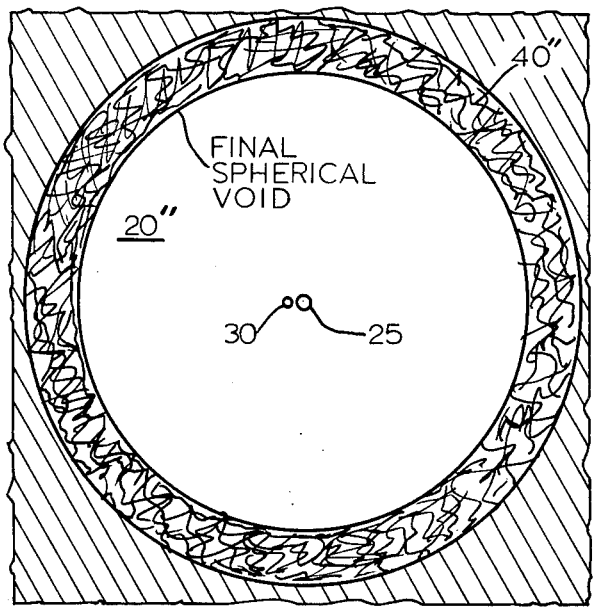
FIG. 6 is a view similar to FIGS. 3, 4 and 5 and showing the coal seam after the gasification process has been completed.

FIG. 3 is a horizontal section view of a shaft 20 and the surrounding coal seam before power is supplied to the torch. The coal 11 is relatively dense, non-porous, homogenous material. FIG. 4 illustrates the coal seam after the torch 25 has been energized so that the devolatilization and fracturing has moved radially outwardly from torch 25 to form a spherical devolatilized zone 40 as a result of the moving heat front 39, but before the steam is introduced. At the point in time depicted in FIG. 4, the fracturing extends radially outwardly approximately 1 meter from torch 25. FIG. 5 shows the seam after the reaction of the fixed carbon and steam has begun and the face of the initial shaft 20 has eroded somewhat to form an enlarged shaft 20' adjacent torch 25. The moving heat front has now extended out approximately 2 meters in all directions from torch 25 as designated by the reference numeral 39' to form a larger devolitilization zone 40'. FIG. 6 shows the seam after the gasification process has been completed at a given gasification site. The gasification of the fixed carbon will have created a final gasified void 20'' which is generally spherical and has a diameter of approximately 4 meters. As described in detail below, the power to torch 25 is discontinued when the void 20'' becomes so large that heat may not be efficiently transferred from the torch to the coal face or when, in a narrow coal seam, most of the coal near the torch has been gasified and a large portion of the heat is being wasted on heating overburden, shale, rock or other non-coal substances. The diameter of the final spherical void 20'' may vary according to the density and porosity of the coal being gasified and the amount of heat being introduced into the shaft. Typical diameters of the void adjacent the torch may range from two to seven meters. After gasification, a large portion of the slag by-product will have settled to the bottom of the shaft. The devolatilized zone will have extended outwardly approximately one meter beyond the face of spherical void 20'' leaving a devolatilized zone 40'' of fractured and devolatilized coal around void 20''. The torch 25 may now be moved upwardly to the next gasification site. It should be pointed out that a spherical void 20'' is produced at each gasification site, and when the torch is raised to the next site within the same shaft 20 another void 20'' is created. Thus, after a number of voids 20'' have been established within a given shaft 20, the shaft will have essentially eroded to form an enlarged cylindrical void.

FIGS. 3–6 are, of course, diagrammatic in form and depict only a horizontal cross section adjacent the torch. The steam injection system will have the ability to control the temperature, pressure and volume of the steam introduced into shaft 20. Such regulation will depend on the underground conditions existing at each site to include steam requirements peculiar to each deposit, and the amount of underground residual moisture being converted to steam by the torch energy. A unique feature of this invention is that significant water leakage into the deposit can be tolerated since the extremely high torch energy will rapidly turn the water into steam. The steam may then be utilized to perform a useful function by reducing or replacing steam injection requirements.

It should be noted that the product gas is being continuously monitored for its Btu content, temperature and mass flow rate. When the gasification process is substantially complete, as shown in FIG. 6, the monitoring will show that the Btu content has decreased, the flow rate has decreased and the temperature of the product gas has increased because the heat from torch 25 is not being efficiently transferred into the coal seam to supply the endothermic heat for the reactions. In the monitoring of the volumetric product gas flow rate it may be determined, for example, by relating Standard Cubic Foot (SCF) rate to KWH input energy that the gasification site should be moved when the flow rate drops below 100 SCF per KWH input energy, thereby indicating that the heat and steam are no longer being efficiently transferred to the coal. The monitoring operation may also be used as a means for controlling the operating parameters such as steam flow rate and torch power during the gasification process.

Figure 8:
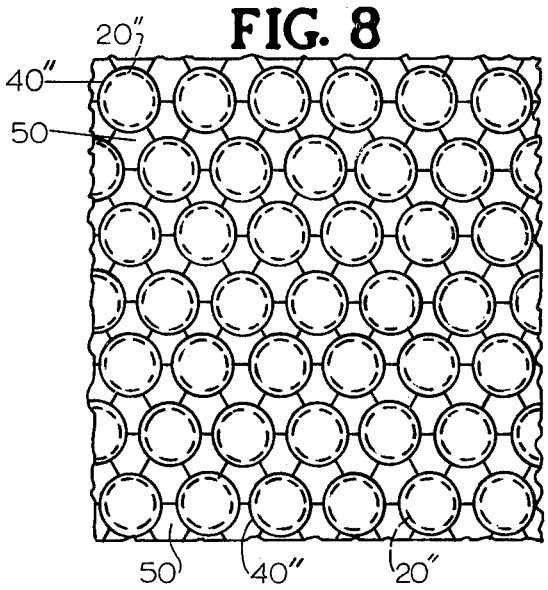
FIG. 8 is a diagrammatic plan view showing the pattern of the adjacent shaft formations after coal gasification and illustrating the support pillars of substantially solid coal and devolatilized ungasified coal which are left behind to prevent surface subsidence.

FIG. 8 shows in plan a preferred array for the positioning of shafts in a typical coal field. The spherical voids 20'' are illustrated after gasification with the surrounding devolatilized zones 40''. The shafts are drilled in a triangular pattern with a minimum distance of approximately 6 meters between the centers of the closest shafts. As illustrated, the shafts may be spaced so that pillars 50 consisting of solid and some devolatilized coal remain between the shafts. Since the gasification of the coal weakens the ability of the deposit to support the overburden, the pillars 50 and the devolatilized zones 40'' may be left behind for support. The diameter of the spherical voids 20'' remaining after gasification will vary with the composition of the coal and with the amount of heat supplied; the distance maintained between adjacent shafts during drilling should be determined accordingly to provide sufficient support. The thickness of the overburden and the thicknesses of the interspersed non-coal layers 12 are also relevant factors in determining the amount of pillar support, if any, which should be left behind. Other arrays may be devised for the shafts. In practice, the portion of a deposit underlying a relatively large area, for example, 10 – 100 acres, may be gasified at the same time. It has been found that the gases being produced adjacent any given shaft may tend to move toward that shaft for withdrawal due to the increased porosity of the coal seam at the shaft wall and increased pressures in the gas-producing shafts. However, since a large number of shafts may be operating simultaneously, the gases which migrate outwardly could be withdrawn through adjacent shafts.

Figure 9:
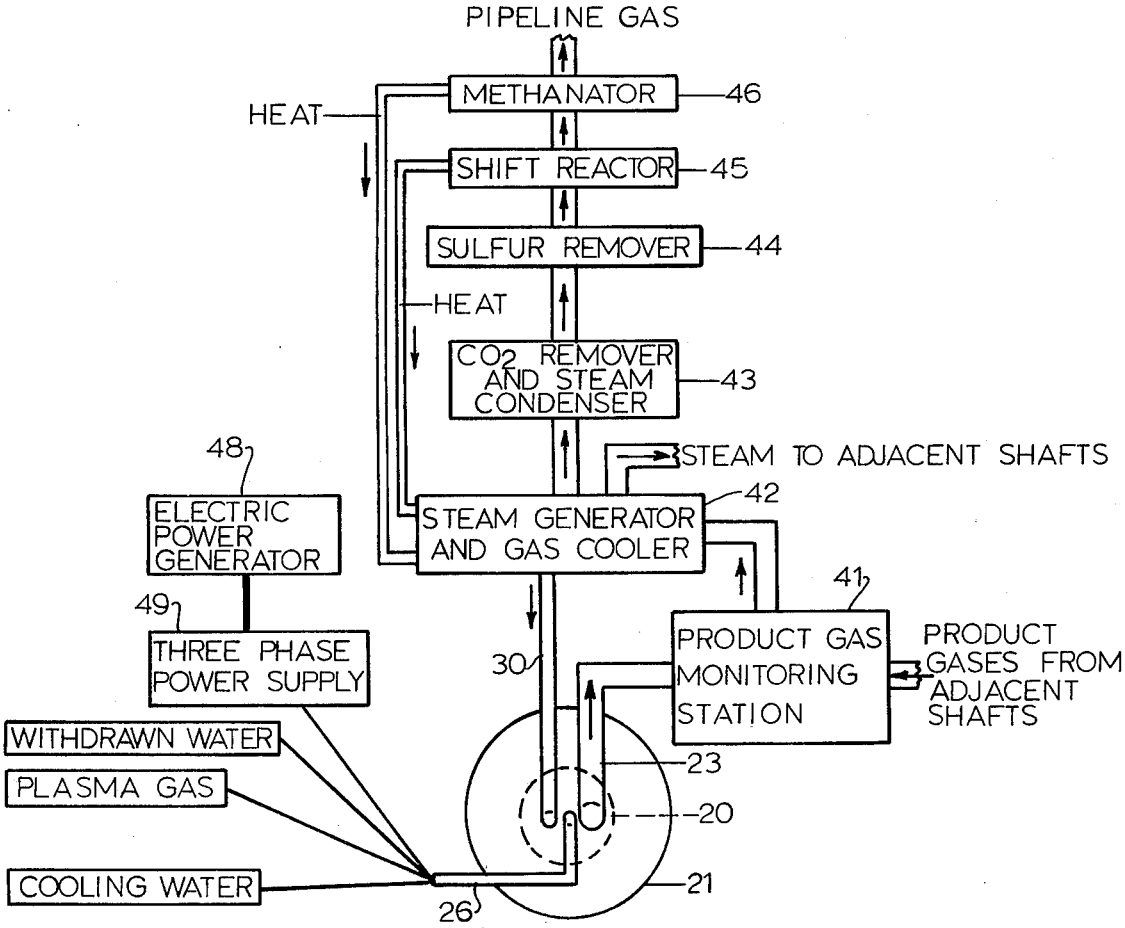
FIG. 9 is a partially schematic view of the surface support elements for the plasma arc torches and the elements used for upgrading the product gas to a pipeline quality gas.

Referring to FIG. 9, the specification will now turn to a description of a preferred surface support system. The product gases from each shaft are directed through its respective removal line 23 to a product gas monitoring station 41. Each station 41 receives the product gases from a number of adjacent shafts. At station 41, the composition and other properties of the gases are carefully screened so that decisions as to when to raise the torches may be made. All of the torches feeding into a respective station 41 preferably will be raised and lowered together according to such screening although the torches may be raised separately, if required. As noted above, when the flow rate and/or the Btu content of the product gases drop below predetermined levels, the gasification is substantially completed and the torches may be raised to the next stratum to be gasified.

The product gases may be upgraded to pipeline quality as the gases move from station 41 to steam generator and gas cooler 42, $CO_2$ remover and steam condenser 43, sulfur remover 44, shift reactor 45 and methanator 46. Steam generator and gas cooler 42 serves to generate the steam which is introduced into each of the adjacent shafts through the respective steam injection lines 30. A portion of the sensible heat from shift reactor 45 and methanator 46 is directed to steam generator and gas cooler 42 to aid in the production of steam.

An electric power generator 48 may be located at the gasification site and could be fueled by the generated steam or a portion of the low Btu product gases as such gases are withdrawn from the shafts. The generator 48 could be used to power a number of three phase power supplies 49, one of which is provided for each set of three shafts.

In operation, the desired number of shafts 20 are drilled into the coal deposit and, if desired, may be spaced in a selected array to assure pillar support. The shafts 20 are drilled through the overburden 13 and into the coal seams to a predetermined depth. The shafts are then suitably lined down to the bottom of the overburden; the portion of the shafts in the coal seams 11 down to the torch location are lined with a lining that is permeable to gases and that is consumed when directly exposed to the torch energy. Below the torch the shaft is unlined. Next, a torch 25 supported by cable 26 and a steam line 30 are lowered to the bottom of each shaft 20. The well cap 21 is secured in place to seal the top of each shaft 20, and the product gas removal line 23 is connected to the respective station 41. Once the torches have been lowered into all of the adjacent shafts, the torches are energized through cables 26 by power supply 49.

The plasma arc torch has the capability of generating heat at various rates. For example, the torch described above for use with the preferred embodiment may operate within a range of three to fifteen million Btu per hour. The heat is initially supplied to the coal seam at a low rate to prevent fusion or glazing of the coal on the wall surface of the shaft. Glazing creates a fluid glass-like layer on the surface of the coal and inhibits the transfer of heat into the seam. Since such glazing takes place at approximately 1500° C, the torch is initially operated at low power to gradually bring the coal near the torch to a temperature of approximately 1000° C to 1300° C. Once a heat front has advanced to preheat and devolatilize a spherical devolitilization zone 40 around the torch (see FIG. 4), steam may be introduced to begin gasifying the coal. As soon as the steam is introduced, the power to the torch should be increased so as to supply the endothermic heat requirements for the water-shift gasification reactions while maintaining the temperature of the coal at or near 1000° C. As the shaft erodes away during gasification, the energy to the torch should be gradually increased since the surface area being exposed to the heat and the gasification rate are constantly increasing. According to an illustrative mode of operation and by way of example and not limitation, the torch may be initially energized to supply heat at approximately 3 million Btu per hour to preheat the seam. After the introduction of steam for gasification, this heat input is gradually increased up to a maximum of approximately 15 million Btu per hour. It has been found that operations according to the invention are preferably carried out by supplying thermal energy to the coal at a rate of 800 – 2000 KWH per ton of coal to be gasified and by supplying steam for utilization at a rate of 0.70 – 1.10 tons per ton of coal for producing product gases at 50–120 SCF per KWH. The product gases so produced have an energy content in the range of 100 to 350 Btu per SCF. A "ton" as used here equals 2000 pounds.

When the monitoring at station 41 indicates that maximum volume of coal has been efficiently gasified, the torch is raised to the next gasification level which has already been preheated by the heat transfer from the previous site immediately below. The torch energy will rapidly consume the permeable lining at this location, exposing the coal directly to the torch energy.

The product gases may be upgraded to pipeline quality by conventional means and a portion of such gases may be used as fuel for supplying the electric power to the torches. The product gases may also be used as reductant gases or for any other desired use. It should be noted that the composition of the product gases may be controlled by the operating temperature and pressures within the shafts. These temperatures and pressures may be controlled in response to the reading at station 41.

Figure 10:
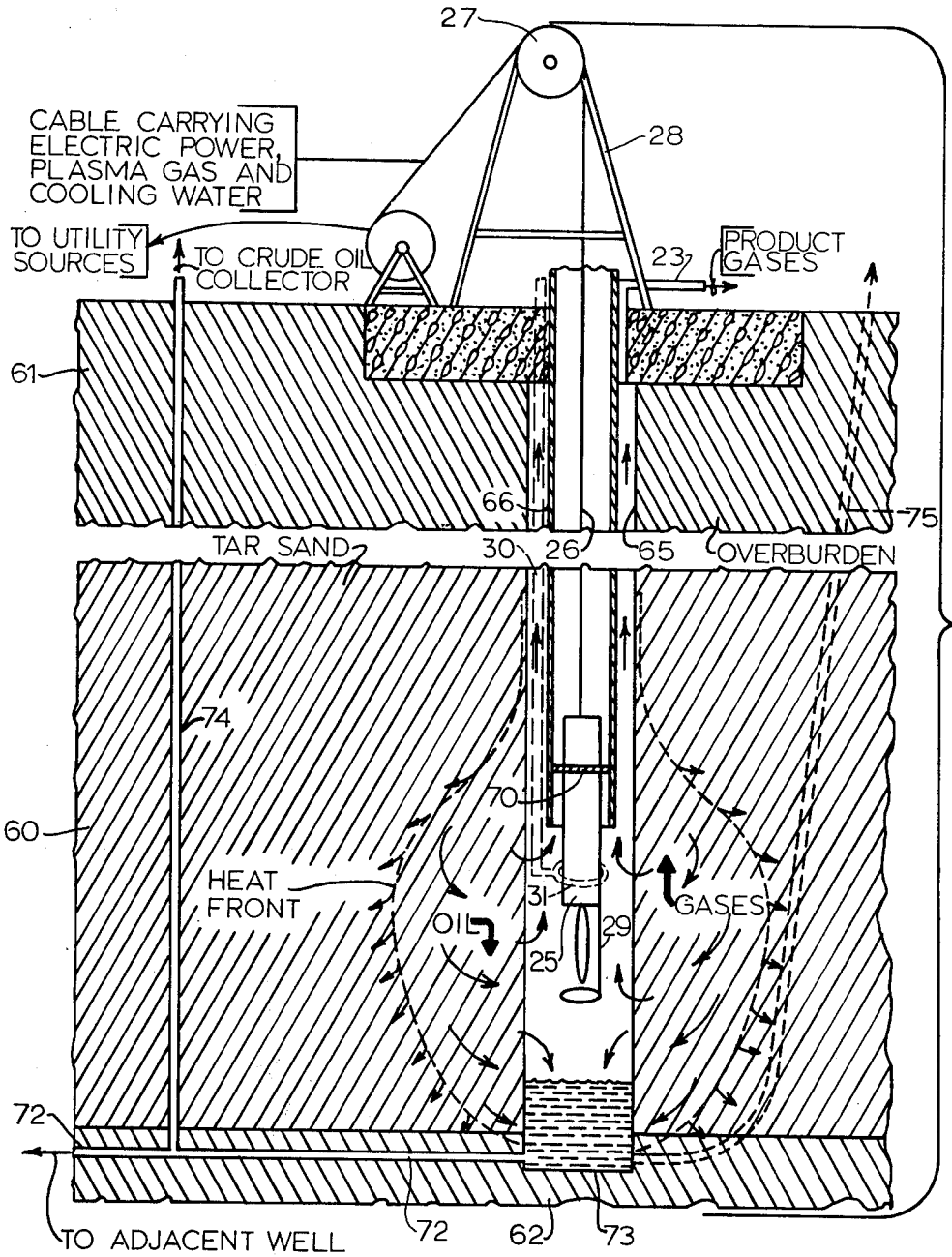
FIG. 10 is an enlarged vertical section view, not to scale, of an embodiment of the invention adapted for an alternate process for recovery of liquid and/or gaseous fuel products from tar sands or oil shale.

Plasma Heating Technique As Applied To Energy Recovery From Tar Sands And Oil Shale Although the process described above for coal pyrolysis is also directly applicable, with minor changes, to the pyrolysis of other hydrocarbons to include tar sands and oil shales, there is an alternate recovery technique for these two types of deposits which may be applied separately or in combination with the aforementioned pyrolysis process. In the embodiment illustrated in FIG. 10 the apparatus and method of the invention is adapted to be used for the recovery of crude oil, and in some instances useful gases, from a tar sand or oil shale deposit. A tar sand deposit 60 is located below an overburden 61 and an emplacement well 65 is provided to introduce the torch 25. The formation shown in FIG. 10 represents a typical deposit in the Athabasca tar sands in Alberta, Canada, having a thickness of approximately 25 meters. On the other hand, some oil shale deposits in Colorado are several hundred feet thick. Other tar sands deposits or oil shale deposits may be utilized.

According to the embodiment described in FIG. 10, it is a primary object to decrease the viscosity of the entrapped oil in a tar sand deposit 60 so that it will flow downwardly to the bottom of the well shaft and be pumped to the surface for collection. As the deposit is heated, the water in the deposit will begin to boil off at approximately 100° C and escape through the well as steam. Mixed with the steam there may be a volume of useful hydrocarbon containing gases which are produced by the pyrolysis of the tar sands in high temperature zones near the torch. It is necessary to heat the entrapped oil to approximately 200° C to decrease its viscosity to a point that it will flow to a collection reservoir. The boiling off of the steam and the heating of the entrapped oil serve to increase the porosity of the sand in an outward direction from the well. Thus, the flow of oil from the deposit will always be directed inwardly toward the well. The increased prosoity also allows good heat transfer outwardly into the deposit.

In the case of oil shale the process is similar, with only minor variations. Oil shale is a solid that contains kerogen, a solid hydrocarbon. Kerogen, when raised to temperatures of approximately 400° C decomposes to form liquid shale oil, similar to crude oil. A solid carbonaceous coke residue, about 25% of the kerogen by weight and similar in composition to the fixed carbon in the devolatilized zone described previously for coal pyrolysis, remains underground. This decomposition of the oil shale rock serves to increase the porosity of the formation in an outward direction from the shaft. Thus, the flow of oil from the deposit will be directed inward toward the well and down into a collection reservoir. The addition of steam to the process, as described previously for coal pyrolysis, may be added to gasify the fixed carbon residue and produce additional gaseous fuel products where economically justified.

Turning now to a detailed description of the invention as applied to tar sands or oil shale and with reference to FIG. 10 in particular, a vertical emplacement well 65 is drilled through the overburden 61 and carbonaceous deposit 60. Preferably, well 65 extends from the ground surface to a point in an underlying layer 62 slightly below the bottom of deposit 60. As described later, the bottom portion of well 65 will serve as a reservoir for collecting the oil which flows from the deposit 60 upon heating. In a preferred embodiment, well 65 is made approximately 0.6 meters in diameter and is adapted to receive a casing 66 which is hung from the ground surface. Casing 66 is approximately 0.4 meters in diameter so that the plasma torch 25 may be transferred therethrough and so that an area remains between casing 66 and well 65 for the removal of product gases. Casing 66 preferably extends downward to cover a portion of the torch so as to protect the torch from any collapsing section of the well 65 and to keep the hot gases away from the torch and the support cable 26. The hot product gases travel outside the casing 66 in the area between the casing and well 65. The path for the hot gases serves to preheat the portion of deposit 60 above the torch while at the same time protecting the torch and support cable. If and when the torch is moved up in the well, the torch will rapidly consume the portion of the casing 66 adjacent the plasma arc column. In the alternative construction, the portion of the well 65 located in the overburden also may be provided with a solid lining to prevent cave-ins and product gas contamination while the portion of the well located in deposit 60 may be unlined. Other linings, well support structures and torch protection means may be utilized without departing from the scope of the invention.

Torch 25 is supported by cable 26 as was described with reference to FIG. 2. Torch 25 is lowered by apparatus 27 into the casing 66. Preferably only the tip of the torch extends from the casing. A loosely seated disc flange 70 serves to center torch 25 within casing 66 and also serves to keep most of the hot product gases out of casing 66.

As the crude oil collects in the reservoir 73 at the bottom of well 65, it is transferred through a small drift or drill hole 72 to a vertical shaft 74 for pumping to the surface. Shaft 74 serves as a common conduit for pumping of oil from a large number of reservoirs which are being filled in the same field. In the alternative, a single slanted hole 75 (as shown in dashed lines) may be drilled to the reservoir at the bottom of each replacement hole for pumping the crude oil to the surface. The common vertical shaft technique is preferable for large fields whereas the single slanted hole technique could be preferable for smaller fields.

In operation, emplacement well 65 is first drilled to a point just below deposit 60. If desired, the lower portion of the well 65 may be enlarged to provide a reservoir of increased volume or, in the alternative, the bottom of the well may be maintained at the same diameter as the well. Next, the consumable casing 66 is inserted into the well 65 so that it terminates approximately at the torch location. The torch 25 and associated cable are lowered so that the tip of torch 25 extends below the end of casing 66. If the casing 66 should initially surround the tip of torch 25 and the external electrode 29, it will be burned away shortly after the torch is started. Torch 25 is started by a conventional starting feature as described in U.S. Pat. No. 3,818,174 so that a continuous stabilized long arc plasma column may be maintained in a transferred mode between the internal electrode of torch 25 and the electrode 29. The intense heat from the plasma column creates a heat front which gradually moves outwardly from the emplacement well 65. By placing the torch 25 approximately midway in the typical tar sands deposit 60, it is expected that the heat from the torch will be transferred vertically within the well 65 so that the torch will not have to be moved vertically during the process. The heat front initially moves quite rapidly and causes the water to boil off at 100° C and causes the oil to flow downwardly through the tar sands as it approaches temperatures of 200° C (400° C in the case of oil shale). The steam and any product gases created by the pyrolysis of a portion of the oil or kerogen move upwardly to the gas collector. The oil is pumped from the reservoir 73 to the common recovery shaft 74 and then to the surface. With continuous operation of the torch 25, the oil may be substantially removed from a substantially cylindrical volume approximately 25 meters high (the depth of deposit 60) and approximately 10 - 20 meters in radius. Heat will be efficiently transferred to the outer extremeties of the cylinder because of the increased porosity existing between the heat front and the torch. A steam reactant may be added to further gasify residual fixed carbon, if economically justified.

In cases of thick tar sand deposits and normal oil shale deposits torch 25 should be initially positioned approximately 10 meters from the bottom of the well and moved up in appropriate increments as the heating process progresses.

It should be noted that the invention as applied to tar sands has as a primary object the recovery of crude oil from the deposit. It is expected that approximately 90% of the recovered energy from tar sands deposits will be in the form of liquid products while approximately 10% will be in gaseous form. In marked contrast, the vast majority of the recovered energy from the coal gasification application is in the form of gases. In the coal gasification application the intense heat serves to devolatilize and gasify essentially all carbonaceous material present in the coal so that such products may be recovered as a gas. An alternative application of the invention to oil shale may combine the above two applications. Although the recovery of crude oil from the oil shale deposit is the primary objective, the large amount of residual fixed carbon remaining in the deposit after the crude oil recovery may justify the addition of a steam reactant to gasify the carbonaceous residue. A steam line 30 and nozzle 31, as shown in dashed lines in FIG. 10, may be used to supply steam to the oil shale deposit.

Thus, it can be seen that the present invention may be used to recover primarily gaseous products from a coal seam wherein the stripping off of the coal volatiles and the reaction of the fixed carbon prevails; or, in the alternative, to recover primarily liquid products from a tar sands or oil shale deposit wherein the application of large amounts of heat serves to allow the entrapped oil or kerogen to flow to collection points for recovery; or, in a combination of the above techniques to recover large amounts of both liquid and gaseous products from an oil shale deposit. Economic considerations may also allow complete pyrolysis of tar sands or oil shale deposits and subsequent total gaseous fuel recovery similar to the above-described coal application.

Since oil wells are often depleted with substantial oil reserves remaining that cannot be economically exploited and in other cases the original well can not be economically extracted because the type oil found is too viscous, the invention readily lends itself to gasification of carbonaceous materials in such depleted wells as well as in the case where the oil viscosity otherwise prevents pumping and can be employed in the manner previously explained with regard to tar sands, oil shale, and the like.

What is claimed is:

1. A method of subjecting a subterranean stratum of carbonaceous matter to heating for effecting a desired physical transformation of such stratum in order to produce recoverable fuel products, comprising the steps of:

a. establishing a shaft from the ground surface communicating with said stratum;
b. lowering a stabilized long arc column forming plasma arc torch with appropriate electric, plasma gas, transferred arc operator, and coolant supply means into said shaft and positioning said torch at a selected depth within said stratum;
c. operating said torch to sustain a stabilized, plasma long arc column in a transferred mode;
d. in the absence of appreciable combustion, utilizing the heat from said plasma column to effect the desired physical transformation of said stratum to recoverable fuel products; and
e. recovering such fuel products from said stratum.

2. A method as claimed in claim 1 wherein said stratum is a coal seam and said physical transformation includes the stripping off of at least a portion of the volatiles in said coal whereby the volatile gases so stripped off are included in said recoverable fuel products.

3. A method as claimed in claim 1 wherein said stratum is a coal seam and including the step of introducing a reactant into contact with said coal seam and wherein said physical transformation includes the reaction of at least a portion of the fixed carbon in said coal with said reactant and the gases so formed are included in said recoverable fuel products.

4. A method as claimed in claim 1 wherein said stratum is a tar sands stratum and said physical transformation includes a decrease in the viscosity of the entrapped oil in said stratum whereby said oil may flow to a collection point for recovery as a said recoverable fuel product.

5. A method as claimed in claim 1 wherein said stratum is an oil shale stratum and said physical transformation includes the liquification of a portion of the kerogen therein whereby the crude oil so formed may flow to a collection point for recovery as said recoverable fuel product.

6. The method of claim 1 including the step of monitoring selected properties of said fuel products as the same are recovered and adjusting the mode of operation of said torch in response to said monitoring.

7. A method for the situ gasification of a subterranean coal deposit in the absence of appreciable combustion wherein a substantial portion of the volatile matter therein is devolatilized and a substantial portion of the fixed carbon therein is gasified, comprising the steps of:

a. establishing at least one substantially vertical well shaft communicating with said coal deposit and descending a selected distance into said deposit, the wall of said shaft being permeable to gases in at least a portion of the shaft which is disposed in said deposit;
b. lowering a plasma arc torch with appropriate electric, plasma gas and coolant supply means into said shaft and positioning said torch in said shaft at a selected gasification level in said deposit;
c. operation said torch to sustain a plasma arc column;
d. allowing the coal-bearing wall portions of said shaft proximate said torch to preheat to a temperature at which at least a portion of the volatile matter therein is stripped off;
e. introducing a reactant into the area proximate said torch to react with the fixed carbon in said coal; and
f. withdrawing the product gas.

8. The method of claim 7 including the step of monitoring selected properties of said product gas as it is withdrawn and adjusting the position of said torch in response to said monitoring.

9. The method of claim 7 including the step of monitoring selected properties of said product gas as it is withdrawn and adjusting selected reaction parameters in response to said monitoring.

10. The method of claim 7 including the step of maintaining the energization of said torch at said selected gasification level until the wall of said shaft has been eroded by the gasification so that a substantially spherical void remains having a diameter in the order of 2 to 7 meters.

11. The method of claim 7 wherein plural shafts are established in a selected coordinate array as viewed in plan providing for support pillars of substantially ungasified coal to be maintained in said deposit after gasification.

12. The method of claim 7 including the steps of collecting said product gas at the ground surface and upgrading said gas to pipeline quality.

13. The method of claim 12 including the step of utilizing a portion of the sensible heat produced in said upgrading step for producing steam to be used as said reactant.

14. The method of claim 7 wherein during the reaction of said reactant with said fixed carbon allowing said shaft to be eroded to form useful gaseous products and a slag by-product and including the step of gradually increasing the input power to said torch and gradually increasing the rate of introducing said reactant as said shaft erodes away and exposes an increasingly larger surface area of fixed carbon to said torch.

15. A method as claimed in claim 7 wherein said plasma torch is of a stabilized long arc column type and said torch is operated to sustain a stabilized long arc column.

16. In an in situ process wherein a subterranean coal deposit is heated in the absence of appreciable combustion, the improvement comprising: operating a plasma arc torch within a coal-bearing segment of a well shaft communicating with said deposit; subjecting the face of said shaft adjacent said torch to a flow of steam; eroding the shaft adjacent said torch by gasifying a substantial portion of the fixed carbon in said coal in the presence of said steam thereby converting said coal to useful product gases and fluid slag; and recovering the product gases through the shaft while allowing at least a portion of the slag to flow downwardly in the shaft.

17. A method as claimed in claim 16 wherein said plasma torch is of a stabilized long arc column type and said torch is operated to sustain a stabilized arc column.

18. A method of transforming coal in situ into recoverable gaseous fuel products comprising the steps of:

a. supplying thermal energy to said coal at a rate of 800 to 2000 kilowatt-hours (KWH) per ton of coal to be gasified utilizing electrical heating means and in the absence of appreciable combustion;
b. supplying steam to said coal for utilization at a rate of 0.70 to 1.10 tons per ton of coal to be gasified; and
c. producing product gases having an energy content of 100 to 350 Btu per standard cubic foot (SCF) at a production rate of 50 to 120 SCF per KWH energy input.

19. An apparatus for heating a subterranean stratum of carbonaceous matter surrounding a shaft communicating therewith and recovering the fuel products released thereby, comprising in combination:

a. a stabilized long arc column forming plasma arc torch having appropriate electric, plasma gas and coolant supply means and being supported in said shaft at a selected position within said stratum;
b. means for operating said torch to sustain said column including means for operating said torch in a transferred arc mode; and
c. means for collecting fuel products produced by the heating of said deposit.

20. An apparatus as claimed in claim 19 including means for introducing steam into said shaft adjacent said torch.

21. An apparatus as claimed in claim 19 including means for continuously analyzing predetermined properties of the fuel products as such products are collected whereby selected operating parameters may be controlled in accordance with such analysis.

22. An apparatus as claimed in claim 19 including a solid lining in said shaft in the overburden overlying said stratum and a permeable lining in said shaft in said stratum, said permeable lining characterized by being consummable when directly exposed to the plasma torch energy.

23. An apparatus as claimed in claim 19 wherein said electric, plasma gas and coolant supply means include a flexible unitary cable structure having in a central portion thereof an insulated electric conductor, a plasma gas line and lines for directing cooling water to said torch and returning such water to the ground surface, said cable structure having a flexible outer cover constructed in a manner allowing said cable structure to serve as a load carrying member for supporting said torch.

24. A method of subjecting a subterranean coal seam stratum to heating for effecting a desired physical transformation of such stratum in order to produce recoverable fuel products, comprising the steps of:

a. establishing a shaft from the ground surface communicating with said stratum;
b. lowering a plasma arc torch with appropriate electric, plasma gas and coolant supply means into said shaft and positioning said torch at a selected depth within said stratum;
c. operating said torch to sustain a plasma arc column;

d. in the absence of appreciable combustion, utilizing the heat from said plasma column to effect the desired physical transformation of said stratum to recoverable fuel products including the stripping off of at least a portion of the volatiles of said coal in said stratum whereby the volatile gases so stripped off are included in said recoverable fuel products; and e. recovering said fuel products from said stratum.

25. A method of subjecting a subterranean coal seam stratum to heating for effecting a desired physical transformation of such stratum in order to produce recoverable fuel products, comprising the steps of:

a. establishing a shaft from the ground surface communicating with said stratum;

b. lowering a plasma arc torch with appropriate electric, plasma gas and coolant supply means into said shaft and positioning said torch at a selected depth within said stratum;

c. operating said torch to sustain a plasma arc column;

d. in the absence of appreciable combustion, utilizing the heat from said plasma column to effect the desired physical transformation of said stratum to recoverable fuel products and including the step of introducing a reactant into contact with said coal seam and wherein said physical transformation includes the reaction of at least a portion of the fixed carbon in said coal in said stratum with said reactant and the gases so formed are included in said recoverable fuel products; and e. recovering such fuel products from said stratum.

26. An apparatus for heating a subterranean stratum of carbonaceous matter surrounding a shaft communicating therewith and recovering the fuel products released thereby, comprising in combination:

a. a column forming plasma arc torch having appropriate electric, plasma gas and coolant supply means and being supported in said shaft at a selected position within said stratum;

b. means for operating said torch to sustain said column;

c. means for introducing steam into said shaft adjacent said torch; and d. means for collecting fuel products produced by the heating of said deposit.

27. An apparatus for heating a subterranean stratum of carbonaceous matter surrounding a shaft communicating therewith and recovering the fuel products released thereby, comprising in combination:

a. a column forming plasma arc torch having appropriate electric, plasma gas and coolant supply means and being supported in said shaft at a selected position within said stratum, said means including a flexible unitary cable structure having in a central portion thereof an insulated electric conductor, a plasma gas line and lines for directing cooling water to said torch and returning such water to the ground surface, said cable structure having a flexible outer cover constructed in a manner allowing said cable structure to serve as a load carrying member for supporting said torch;

b. means for operating said torch to sustain said column; and c. means for collecting fuel products produced by the heating of said deposit.

* * * * *

UNITED STATES PATENT OFFICE

CERTIFICATE OF CORRECTION

Patent No. 4,067,390 Dated January 10, 1978

Inventor(s) Salvador Lujan Camacho and Louis Joseph Circeo,Jr.

It is certified that error appears in the above-identified patent and that said Letters Patent are hereby corrected as shown below:

Col. 1, line 20, Insert --of-- after "deposits".

Col. 1, line 22, second occurrence of "and" should be --of--.

Col. 2, line 19, "combusion" should be --combustion--.

Col. 2, line 20, "dilute" should be --diluted--.

Col. 2, line 51, "reliaby" should be --reliably--.

Col. 3, line 21, "first" should be --fire--.

Col. 3, line 46, "drivng" should be --driving--.

Col. 4, line 26, "methods" should be --method--.

Col. 5, line 20, "preferrably" should be --preferably--.

Col. 6, line 46, "preferble" should be --preferable--.

Col. 11,line 60, "prosoity" should be --porosity--.

UNITED STATES PATENT OFFICE

CERTIFICATE OF CORRECTION

Patent No. 4,067,390 Dated January 10, 1978

Inventor(s) Salvador Lujan Camacho and Louis Joseph Circeo, Jr.

It is certified that error appears in the above-identified patent and that said Letters Patent are hereby corrected as shown below:

Col. 13, line 32, "extremeties" should be --extremities--.

Col. 16, line 7, Insert --long-- after "stabilized".

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*